US005779510A

United States Patent [19]

Skedelski

[11] Patent Number: 5,779,510

[45] Date of Patent: Jul. 14, 1998

[54] SURFBOARD LEASH ATTACHMENT

[75] Inventor: David Skedelski, Aiea, Hi.

[73] Assignee: Surfco, Hawaii, Aiea, Hi.

[21] Appl. No.: 810,853

[22] Filed: Mar. 4, 1997

[51] Int. Cl.[6] ..... B63B 1/00

[52] U.S. Cl. ..... 441/75

[58] Field of Search ..... 441/65, 67, 72, 441/74, 75; 114/218, 249, 253

[56] References Cited

U.S. PATENT DOCUMENTS

| | | | |
|---|---|---|---|
| 4,107,806 | 8/1978 | Newland et al. | 441/75 |
| 4,331,093 | 5/1982 | Moller | 441/74 |
| 4,592,734 | 6/1986 | Metiver | 441/74 |
| 4,938,725 | 7/1990 | Beck | 441/75 |
| 5,167,553 | 12/1992 | Wilson | 441/75 |
| 5,362,270 | 11/1994 | Hanson et al. | 441/75 |
| 5,460,558 | 10/1995 | Woodstock | 441/74 |
| 5,484,312 | 1/1996 | Zepeda | 441/74 |

FOREIGN PATENT DOCUMENTS 9054940 11/1990 Australia .

OTHER PUBLICATIONS

O'Fish'L Surf Products flyer "The Glue On Leash Attachment", 1995.

O'Fish'L "Glue On Leach Attachment" package, 1996.

3M VHB Double Coated Acrylic Foam Tapes . . . Technical Data, Aug., 1994.

Pellethane Thermoplastic Polyurethane Elastomers, Product Sheet; prior art.

"Isoplast Resins" product sheet (prior art).

3M Primer 94 Directions (prior art).

*Primary Examiner*—Jesus D. Sotelo

*Attorney, Agent, or Firm*—Nixon & Vanderhye P.C.

[57] ABSTRACT

A leash attachment for sport boards, such as surfboards, does not interfere with operation of the board, does not require any deformation or reconstruction of the board, and is extremely simple to apply yet very effective in utilization. The attachment includes an integral plastic body having a substantially flat bottom face and a contoured (as opposed to sharp edged) top, the contoured top defining an eye large enough to receive a leash. A double face very high bond permanent pressure sensitive adhesive tape is substantially permanently attached to the flat bottom face, and to a sport board, e.g. at or adjacent the rear termination of a surfboard. The integral body may be hard plastic comprising about 30–50% glass filled injection moldable thermoplastic resin, or of elastomeric material such as urethane elastomer having a durometer of between about 60–90 Shore A. The body has a larger length than width and a small height and a substantially almond shaped configuration in plan.

19 Claims, 3 Drawing Sheets

Fig. 1
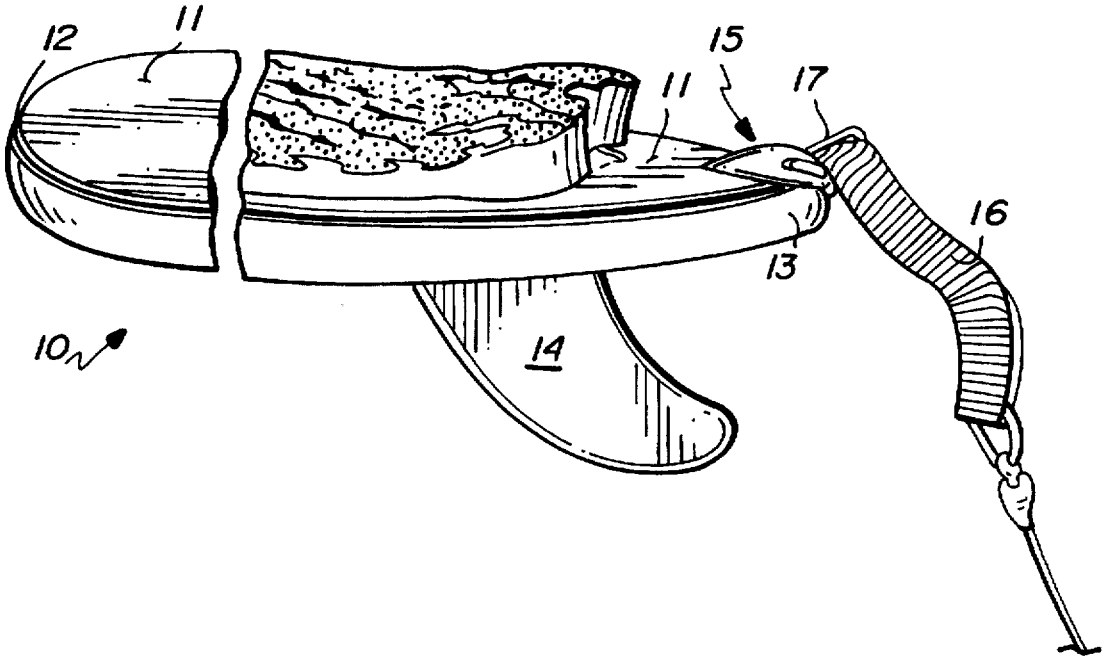
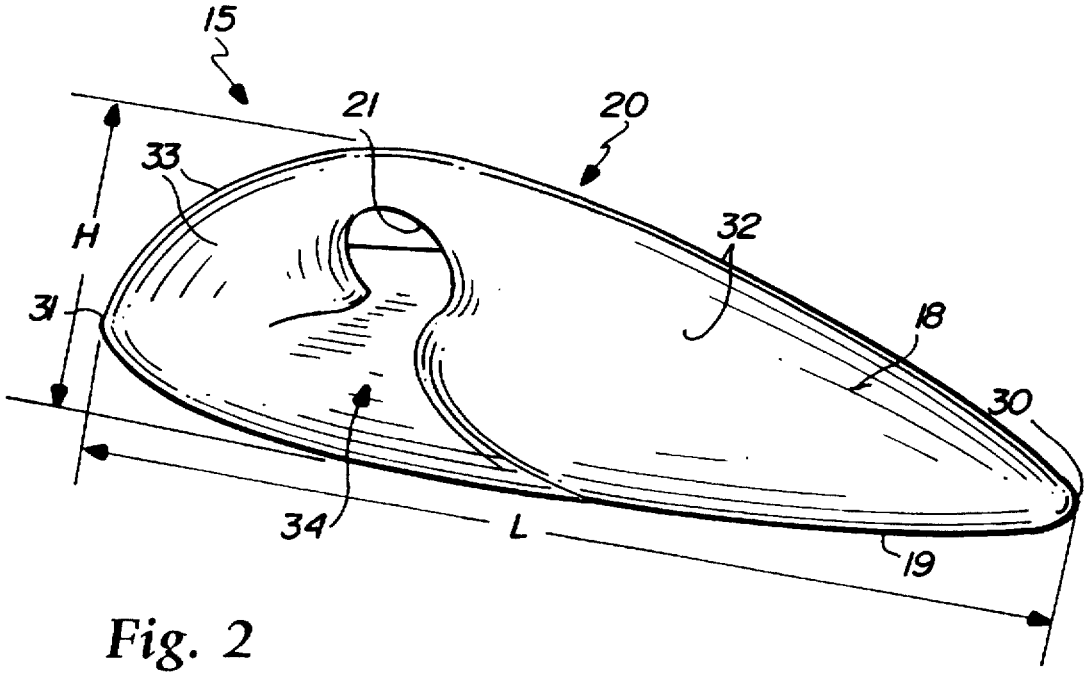
Fig. 2

Fig. 4
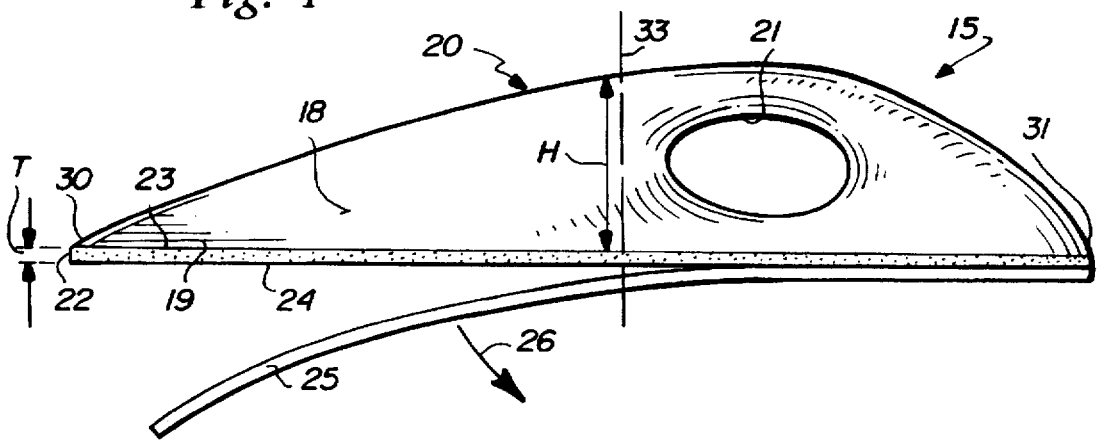
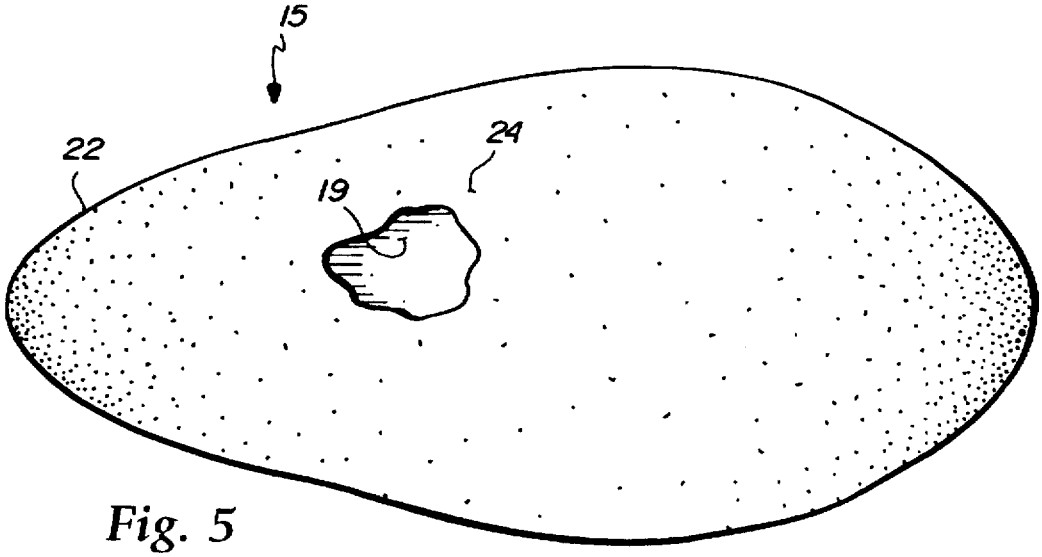
Fig. 5

SURFBOARD LEASH ATTACHMENT

BACKGROUND AND SUMMARY OF THE INVENTION

On many sport boards, particularly skateboards, snowboards, wakeboards, bodyboards, and especially surfboards, for safety reasons it is desired to attach a leash to the board. The leash is attached to the surfboard close to the rear termination, and to the surfer by a wrist or ankle strap. The leash is sufficiently long to minimize the chance of injury to the surfer when he or she becomes dismounted from the board, while enabling the surfer to readily recover the board for remounting.

The conventional way for mounting a leash to a sport board is to permanently set a plug in or recessed below the surface of the board at the time of manufacture. However the installation of these "plugs" is a time consuming process, and does not allow adjustment of the position of the device to suit a particular end user's use. Also for some boards because of their cross-sectional configuration the recessed plug cannot be located in an optimum position. Also if the plug is broken it cannot be repaired or easily replaced, and it can be difficult to effectively attach a leash to an eyelet or shaft of the plug because of its recessed nature. Conventional plugs are illustrated in U.S. Pat. No. 4,107,806, 4,938,725 and 5,362,270.

It has relatively recently been recognized that certain advantages can be obtained if the leash securing device is mounted to the top of a sport board, such as a surfboard. For example Australian patent 648024 provides a wide variety of different configurations of attachment devices, of both rigid or elastomeric materials, which may be affixed by adhesive, resins, hook and loop fasteners, or pins. Another such product is sold by O'Fish'L Surf Products of Capistrano Beach, Calif. under the name "Glue On Leash Attachment". This product has a circular configuration with a flat face and a dome with eye, and is attached to a surfboard using epoxy While both the Australian patent structure and the O'Fish'L construction can be effective, they do not have optimum hydrodynamic characteristics and/or the installation process is time consuming or it will be ineffective.

According to the present invention a leash attachment for sport boards, and in combination with sport boards such as a water sport board (e.g. a surfboard), is provided which has optimum hydrodynamic characteristics to allow efficient water flow over the tail section of the surfboard or other water sport board, and regardless of the sport board with which it is used can be extremely easily affixed in place, in the desired location. A particular desired location is immediately at the rear end termination of a surfboard.

According to the present invention a leash attachment for sport boards is provided comprising: An integral plastic body having a substantially flat bottom face, and a contoured top, the contoured top defining an eye large enough to receive a leash. And, a double face very high bond permanent pressure sensitive adhesive tape having first and second faces, the first face with very high bond pressure sensitive adhesive engaging the flat bottom face to substantially permanently attach the tape to the integral body. The leash attachment is particularly useful with water sport boards, and the body is preferably elongated in a first dimension (having a longer length than width), and the eye defines the second dimension contoured in the first dimension to provide minimal resistance to water. For example the integral body may have a substantially almond shaped configuration in plan, including a leading end most remote from the rear termination of a board with which it is used, and a trailing end at or adjacent the rear termination, the body between the eye and the leading end having a bulbous configuration. The eye is located substantially to the rear of an imaginary plane perpendicular to the first dimension and bisecting the body. The body typically has a length in the first dimension of between about 1⅝ inches and 2¼ inches (depending upon the size of the sport board with which it is utilized), and a maximum width at least about one-half inch less than its length, and a height of about one-half inch or less.

The integral body of the leash attachment may be of hard plastic, such as 30–50% (e.g. about 40%) glass filled injection moldable thermoplastic resin such as ISOPLAST thermoplastic resin available from Dow Chemical Company. Alternatively the integral body may be made of elastomeric material, such as a urethane elastomer (like PELLETHANE available from Dow Chemical Company) with a durometer of between about 60–90 Shore A (e.g. about 70–80 Shore A).

The double face very high bond permanent pressure sensitive adhesive tape typically has a thickness of between about 40–50 mils (e.g. about 45 mil) with one face permanent attached to the flat bottom face of the body, and the other face engaging the top surface of the sport board. One particular tape that may be utilized is very high bond series 3-M adhesive tape (such as product nos. 4941 or 4945).

When used in combination with a water sport board having a tail with the top surface, and a rear termination, and elongated in a third dimension, the second face of the tape very high bond pressure sensitive adhesive engages the tail top surface with the first and third dimensions aligned, and the integral body is positioned substantially at (e.g. immediately at) or adjacent the rear termination. A leash may readily be passed through the eye and tied, or clipped on. Installation time is a matter of seconds.

It is the primary object of the present invention to provide a leash attachment that is unobtrusive, does not interfere with the operation of the board with which it is utilized, is easily positively affixed to the board, yet performs its intended function successfully. This and other objects of the invention will become clear from an inspection of the detailed description of the invention and from the appended claims.

BRIEF DESCRIPTION OF THE DRAWINGS

FIG. 1 is a perspective view showing an exemplary leash attachment according to the present invention mounted at the rear termination of a surfboard to provide a combination according to the invention;

FIG. 2 is a top perspective view of the integral body of the leash attachment of FIG. 1;

FIG. 4 is a side view of the leash attachment of FIGS. 1 and 3; and

FIG. 5 is a bottom view of a leash attachment of FIG. 4.

DETAILED DESCRIPTION OF THE DRAWINGS

Figure 3:
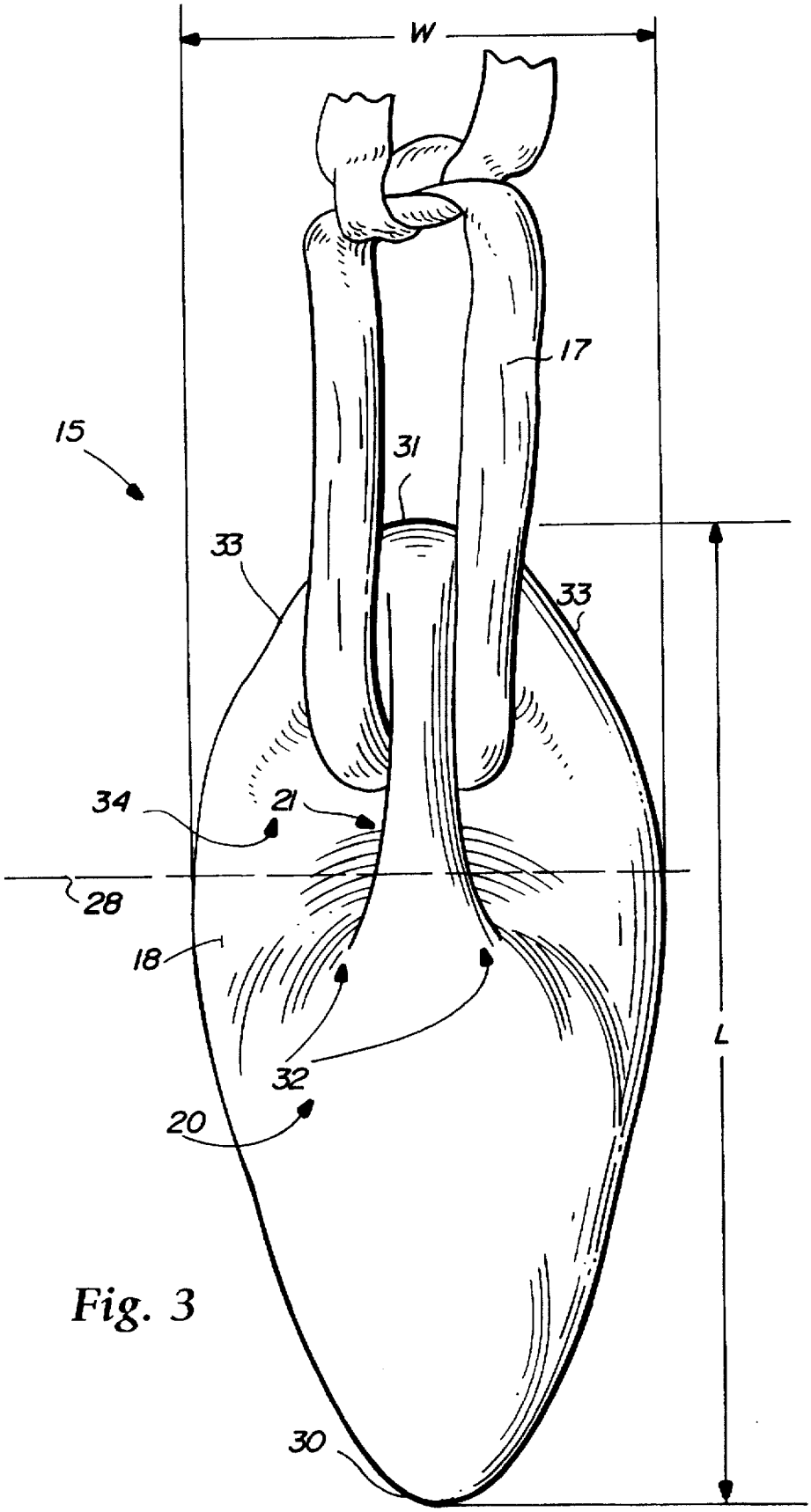
FIG. 3 is a top plan view of the leash attachment of FIGS. 1 and 2.

FIG. 1 shows a conventional surfboard 10 which has a top surface 11 in which the user rides, a front 12, a rear termination 13, and—in this particular embodiment—a fin 14. The surfboard 10 is shown in combination with a leash attachment 15 according to the invention, the leash attachment 15 being shown connected to a conventional leash 16, via a cord 17 which is part of the leash 16 and actually makes the connection with the leash attachment 15.

The leash attachment 15 is shown in more detail in FIGS. 2 through 5 and comprises an integral plastic body 18 having a substantially flat bottom face and a contoured top shown generally by reference numeral 20 in FIGS. 2 through 4. That is the top 20 is contoured as opposed to containing sharp edges or lines of demarcation. The contoured top 20 defines an eye 21 which is large enough to receive a leash (e.g. the cord 17 as illustrated in FIG. 3).

The leash attachment 15 also comprises a double face very high bond permanent pressure sensitive adhesive tape 22 (see FIGS. 4 and 5). A first face 23 of the tape has very high bond pressure sensitive adhesive which engages the flat bottom 19 of the body 18 to substantially permanently attach the tape 22 to the body 18. The second or bottom face 24 of the tape 22 also is very high bond permanent pressure sensitive adhesive and is affixed directly to the top surface 11 of the sport board 10, as illustrated in FIG. 1. There is no sanding necessary, except to ensure that the top surface 11 of the board 10 to which the adhesive 24 is to be applied should be clean and dry. A 3-M primer 94, is then applied to the surface of the sport board. The face 24 may be covered with a conventional release liner 25 (which typically has a silicone coating) so that the leash attachment 15 may be shipped and sold in a package without the adhesive of the face 24 sticking to parts of the package, the release liner 25 being readily removed at the use site—merely by peeling it back, as indicated schematically by the arrow 26 in FIG. 4.

While a variety of different tapes 22 may be provided, a preferred tape according to the invention has a thickness T (see FIG. 4) of about 40–50 mil, e.g. about 45 mil. While as illustrated in FIG. 5 the tape 22 preferably covers the entire bottom face 19 of the body 18, the tape 22 may be discontinuous if necessary or desired, or only cover a central band of the bottom 19, as long as it has sufficient holding power to hold the body 18 in place on the board 10 during normal use, for an extended period of time. One particular tape that may be utilized is from 3-M of Minneapolis, Minnesota, product nos. 4941 or 4945, very high bond (VHB) series.

The body 18 may be of either hard or soft plastic. If of hard plastic, for example it may comprise a reinforced injection moldable thermoplastic resin with between about 30–50% glass, e.g. about 40% glass filled injection moldable thermoplastic resin, such as ISOPLAST available from Dow Chemical Company. If of soft material, the body 18 may be of elastomeric material, e.g. urethane elastomer having a durometer of between about 60–90 Shore A, e.g. PELLETHANE about 70–80 A durometer material available from Dow Chemical Company.

In order to minimize any adverse affect on board operation, especially for water sport boards, and most especially for surfboards, the body 18 is elongated in a first dimension, having a length L (see FIGS. 2 and 3) which is greater than its maximum width W (see FIG. 3). The eye 21 defines a second dimension 28 (see FIG. 3) which is parallel to the width W and substantially transverse to the first dimension defined by the length L. The body 18 preferably has a length L (in the first dimension), depending upon the size of the board with which it will be utilized, of between about 1⅝ inch and about 2¼ inches, e.g. about two inches, particularly where the board 10 is a surfboard. The width W of the body 18 is preferably at least one-half inch less than its length L, for example for a length L of about two inches the width W is about 1¾ inches. The body 18 also has a small height H (see FIGS. 2 and 4) of about one-half inch or less (e.g. no more than about ⅝ inch).

The particular configuration illustrated in FIGS. 2 through 4 is also particularly hydrodynamic, allowing efficient water flow over the tail of the board 10 with which it is utilized, and complementing the hydrodynamic shape of the board 10. That is the body 18 has a substantially almond shaped configuration in plan (see FIGS. 3 and 5), having a front (leading) end 30 (which is closest to the front of the board 10 with which it is utilized), and a back (trailing) end 31, the front end 30 having a slightly higher angle of taper than the back end 31, which is more rounded. Between the leading end 30 and the eye 21 the body 18 preferably has a bulbous configuration, as illustrated at the general area of reference numeral 32 in FIGS. 2 and 3. To the rear of the eyelet 21 the body 18 also is preferably bulbous as indicated generally at 33 in FIGS. 2 and 3, with a contoured depression indicated generally by reference numeral 34, below the eyelet 21 and in between the bulbous portions 32, 33. The eye 21 is located substantially (that is at least primly, but preferably completely) to the rear of an imaginary plane—seen at 33 in FIG. 4—bisecting the body 18 and perpendicular to the first dimension (that is parallel to the width dimension W).

When the leash attachment 15 according to the invention is in combination with the water sport board 10, particularly a surfboard as illustrated in FIG. 1, it is mounted at or adjacent the rear termination 13. Preferably it is mounted immediately at the rear termination 13, as seen in FIG. 1 where the trailing end 31 is within an inch, preferably within a centimeter, of the end termination 13 (i.e. the rearward most part of the substantially flat or gently curved top surface 11 of the board 10). In this location the first dimension (length) of the body 18 is also aligned with the length of the surfboard 10, and the first dimension of the body 18 is co-extensive with the longitudinal center line of the surfboard 10, and an imaginary line thereto passes over the fin 14. In any event if the surfboard 10 has a fin 14, the leash attachment 15 is preferably mounted to the surfboard 10 at some point to the rear of the attachment of the fin 14 to the bottom of the surfboard 10.

While the invention is particularly useful with water sport boards, such as sailboards, wakeboards, bodyboards, and particularly surfboards, it also may be utilized with other sport boards such as snowboards and skateboards. With skateboards and snowboards rear board mounting of the leash attachment 15 is not as important as for water sport boards, particularly surfboards.

It will thus be seen that according to the present invention an advantageous leash attachment is provided, including in combination with a sport board. The leash attachment may easily be applied to a sport board merely by removing the release liner 25 from the tape 22 surface 24 and then pushing the properly aligned leash attachment 15 tape surface 24 into the proper location on the board 10, the application typically taking only a matter of seconds.

The leash attachment according to the present invention allows sufficient water flow over the tail section of a water sport board, complements the hydrodynamic shape of a water sport board (particularly a surfboard), and additionally is aesthetically pleasing. Also because it is completely contoured (having no sharp edges or sharp lines of demarcation) it has maximum safety associated therewith since if it were to impact the user's foot or other part of his or her body it would be very unlikely to cause a cut or severe abrasion, particularly if made of elastomeric material.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equipment structures and devices.

What is claimed is:

1. A leash attachment for sport boards, comprising:

an integral plastic body having a substantially flat bottom face, and a contoured top, said contoured top defining an eye large enough to receive a leash; and a double face very high bond permanent pressure sensitive adhesive tape having first and second faces, said first face with very high bond pressure sensitive adhesive engaging said flat bottom face to substantially permanently attach said tape to said integral body and said second face adhesive substantially permanently attached to a surface of a sport board.

2. A leash attachment and sport board combination as recited in claim 1 wherein said sports board comprises a water sport board, and wherein said body is elongated in a first dimension and wherein said eye defines a second dimension substantially perpendicular to said first dimension, and wherein said body is contoured in said first dimension to provide minimal resistance to water.

3. A leash attachment for sport boards as recited in claim 2 in combination with a water sport board having a tail with a top surface, and a rear termination, and elongated in a third dimension, said second face of said tape having very high bond pressure sensitive adhesive engaging said tail top surface with said first and third dimensions aligned, and said integral body positioned substantially at or adjacent said rear termination.

4. A leash attachment and water sport board combination as recited in claim 3 herein said integral body comprises about 30–50% glass filled injection moldable thermoplastic resin hard plastic.

5. A leash attachment and water sport board combination as recited in claim 3 wherein said integral body comprises urethane elastomer having a durometer of between about 60–90 Shore A.

6. A leash attachment and water sport board combination as recited in claim 3 wherein said integral body has a substantially almond shaped configuration in plan, including a leading end most remote from said rear termination and a trailing end at or adjacent said rear termination, said body between said eye and said leading end having a bulbous configuration, and said eye located substantially to the rear of an imaginary plane perpendicular to said first dimension and bisecting said body.

7. A leash attachment and water sport board combination as recited in claim 6 wherein said tape is about 40–50 mil thick.

8. A leash attachment and water sport board combination as recited in claim 6 wherein said water sport board comprises a surfboard.

9. A leash attachment and water sport board combination as recited in claim 6 wherein said body is elongated in a first dimension and wherein said eye defines a second dimension substantially perpendicular to said first dimension; and wherein said body has a length in said first dimension of between about one and five-eighths and two and one-quarter inches, and a maximum width at least about one-half inch less than its length, and a height of about one-half inch or less.

10. A leash attachment and sport board combination as recited in claim 1 wherein said body is elongated in a first dimension and wherein said eye defines a second dimension substantially perpendicular to said first dimension; and wherein said body has a length in said first dimension of between about one and five-eighths and two and one-quarter inches, and a maximum width at least about one-half inch less than its length, and a height of about one-half inch or less.

11. A leash attachment and sport board combination as recited in claim 1 wherein said integral body has a substantially almond shaped configuration in plan, including a leading end and a trailing end, said body between said eye and said leading end having a bulbous configuration, and said eye located substantially to the rear of an imaginary plane perpendicular to said first dimension and bisecting said body.

12. A leash attachment for sport boards comprising:

an integral plastic body having a substantially flat bottom face, and a contoured top, said contoured top defining an eye large enough to receive a leash; and a double face very high bond permanent pressure sensitive adhesive tape having first and second faces, said first face with very high bond pressure sensitive adhesive engaging said flat bottom face to substantially permanently attach said tape to said integral body; and wherein said body is elongated in a first dimension and wherein said eye defines a second dimension substantially perpendicular to said first dimension; and wherein said integral body has a substantially almond shaped configuration in plan, including a leading end and a trailing end, said body between said eye and said leading end having a bulbous configuration, and said eye located substantially to the rear of an imaginary plane perpendicular to said first dimension and bisecting said body.

13. A leash attachment for sport boards as recited in claim 12 wherein said integral body is of hard plastic.

14. A leash attachment for sport boards as recited in claim 13 wherein said hard plastic comprises about 30–50% glass filled injection moldable thermoplastic resin.

15. A leash attachment for sport boards as recited in claim 12 wherein said integral body is of elastomeric material.

16. A leash attachment for sport boards as recited in claim 12 wherein said integral body is of elastomeric material having a durometer of between about 60–90 Shore A.

17. A leash attachment for sport boards as recited in claim 12 wherein said tape is about 40–50 mil thick.

18. A leash attachment for sport boards as recited in claim 17 further comprising a release liner covering said second face of said adhesive.

19. A leash attachment for sport boards as recited in claim 12 wherein said body is elongated in a first dimension and wherein said eye defines a second dimension substantially perpendicular to said first dimension; and wherein said body has a length in said first dimension of between about one and five-eighths and two and one-quarter inches, and a maximum width at least about one-half inch less than its length, and a height of about one-half inch or less.

* * * * *